United States Patent [19]

Rigo et al.

[11] 4,108,736

[45] Aug. 22, 1978

[54] METHOD OF PRODUCING PROTECTIVE COATINGS

[75] Inventors: Serge Rigo, Drancy; Julius Siejka, Paris, both of France

[73] Assignee: Agence Nationale de Valorisation de la Recherche (Anvar), Neuilly-sur-Seine, France

[21] Appl. No.: 526,915

[22] Filed: Nov. 25, 1974

[30] Foreign Application Priority Data

Nov. 23, 1973 [FR] France ..... 73 41847
Jul. 26, 1974 [FR] France ..... 74 26017

[51] Int. Cl.[2] ..... C25D 11/04; C25D 11/26; C25D 11/28; C25D 11/32

[52] U.S. Cl. ..... 204/1.5; 204/38 A; 204/42; 428/623; 428/629; 428/630; 428/633

[58] Field of Search ..... 428/472, 470, 469, 539, 428/623, 629, 630, 633; 204/56 R, 42, 38 A, 58, 1.5; 29/195 T

[56] References Cited

U.S. PATENT DOCUMENTS

| | | | |
|---|---|---|---|
| 3,075,896 | 1/1963 | McGraw et al. | 204/37 |
| 3,294,653 | 12/1966 | Keller et al. | 204/15 |
| 3,378,471 | 4/1968 | Vermilyea | 204/56 R |
| 3,457,148 | 7/1969 | Waggener | 204/56 R |
| 3,493,475 | 2/1970 | Neugebauer et al. | 204/33 |
| 3,645,862 | 2/1972 | Cotton et al. | 204/56 R |
| 3,764,398 | 10/1973 | Nishihara et al. | 204/56 R X |
| 3,784,951 | 1/1974 | Steidel | 204/38 A X |
| 3,798,139 | 3/1974 | Schwartz | 204/56 R |
| 3,859,178 | 1/1975 | Logan et al. | 205/15 |
| 3,882,000 | 5/1975 | Schwartz et al. | 204/38 A |

FOREIGN PATENT DOCUMENTS

| | | | |
|---|---|---|---|
| 20,606 | 9/1968 | Japan | 204/56 R |

OTHER PUBLICATIONS

S. Rigo et al., Solid State Communications, vol. 15, pp. 259–264, (1974).

*Primary Examiner*—G. L. Kaplan
*Attorney, Agent, or Firm*—Weiser, Stapler & Spivak

[57] ABSTRACT

The invention relates to a method for forming surface coatings on a substrate by anodic oxidation, wherein the substrate contains, at least in those of its parts which are immediately sub-adjacent to its surface, at least one element selected from niobium, chromium, molybdenum, tungsten, titanium and vanadium, or a conducting compound containing such a first element, and at least one second element, different from the first, selected notably from silicon, aluminum, gallium, tantalum, uranium and molybdenum, either in the metallic state, if it constitutes itself a semi-conductor element, or even an insulator, or in the combined or alloyed state with at least one other element to form a semi-conductor compound, or even an insulator, said second element being flush at least in part at the surface of the substrate.

The invention also relates to the coatings themselves and which comprise a superficial layer and an inner layer of an oxide of the first element separated by an intermediate layer containing an oxide of the second element.

24 Claims, 3 Drawing Figures

METHOD OF PRODUCING PROTECTIVE COATINGS

Figure 2:
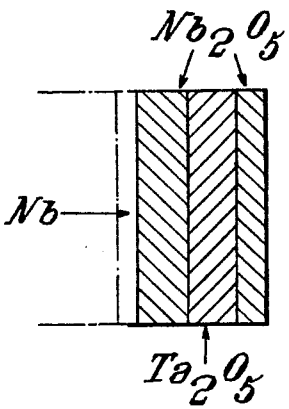

The invention relates to a method for producing surface coatings, to the coatings themselves, obtained by this method and to the parts or substrates comprising such coatings.

It is known that it is necessary to produce surface coatings, more particularly on metallic parts or substrates, in numerous and extremely varied fields of application. There may be mentioned, for example, the case of the production of surface coatings for protecting substrates of the type concerned against corrosion or, in quite another field, production of resistive structures in thin layers.

Similar problems may however be encountered in different fields of use. If for example in the case of protecting substrates, niobium is deposited, to combat corrosion, it may be recalled that the most current techniques used for forming this protection consist essentially of depositing on these substrates intermetallic or analogous compounds and of converting these deposits, for example by the effect of heat treatment at high temperature, into protective coatings of the type concerned. Such heat treatments are prejudicial to the mechanical properties of the parts or substrates to be protected.

In addition, and more important, is the fact that the protective coatings that can be obtained by known methods do not always have the degree of insulation which may be desired in numerous applications of the parts of the type concerned. A defect of insulation, for example through pitting, readily renders this protection ineffective, and this in irreversible manner.

In another field mentioned by way of example, that of the manufacture of thin resistive layers, for example based on pure tantalum, on nitrided tantalum or tantalum saturated with dissolved oxygen, on tantalum-aluminum or tantalum-silicon, etc., alloys, it has already been proposed to have recourse to anodic oxidation of these materials to control with accuracy the values of the resistance of these resistive layers. However, the application of this technique, like other known techniques for producing such resistive layers, has continued to pose an essential problem to which a satisfactory solution has not hitherto been found. This problem relates to modifications of the resistive layer which can occur in the course of time under the effect of the external medium, especially at high temperatures, and which result in a change in the value of its electrical resistance, for example because the resistive layer changes in composition, or it undergoes corrosion. Thus, in particular solubilization of atmospheric oxygen or nitrogen may occur in the resistive layer in the course of its utilization, or an increase in the thickness of the film of oxide present on the surface of the resistive layer, may occur, taking into account the high affinity of tantalum with respect to oxygen. In all cases, an irreversible variation in the value of the resistance results therefrom.

It will be appreciated therefore that all these methods have in common the disadvantage that they do not permit satisfactory control and preservation in time of the composition of the surface layers formed on the treated substrates.

It is accordingly an object of the invention to provide a method which enables these drawbacks of the prior art method to be overcome, for example which enables coatings to be formed under particularly simple conditions and only involving in addition treatment at temperatures which are not particularly high, and quite compatible with the preservation of the mechanical properties of the substrate.

It is a particular object of the invention, to provide within the field of anti-corrosion protection, strong and highly insulating coatings. More particularly, it is a further object, in this field of anti-corrosion protection, to make possible the regeneration of deteriorated protective coatings, and even improvement of the characteristics of protective coatings obtained by other methods.

It is another object of the invention to provide a method which enables strict control of the conditions under which this coating is formed, which strict control is used especially in the field of resistive thin layer structures, to obtain in an accurate manner the ohmic resistances of the latter.

The invention applies the discovery that anodic oxygen enables these objects to be achieved when it is applied to substrates containing associations of elements selected according to particular conditions close to the surfaces of the parts or substrates thus treated.

The method according to the invention consists essentially of subjecting to anodic oxidation treatment a substrate containing, at least in those of its parts which are immediately subadjacent to its surface, at least one first element selected from niobium, chromium, molybdenum, tungsten, titanium, venadium or a conductive compound containing such a first element, and at least one second element, different from the first, preferably selected for example from silicon, aluminum, gallium, tantalum, uranium and molybdenum, either in the metallic state, if it constitutes itself a semiconductive compound or if it is suitable for forming by oxidation a semiconductor compound or even an insulator, or in the combined state with at least one other element to form a semiconductor compound, or even an insulator, the said second element being flush at least in part with the surface of the substrate. The anodic oxidation is effected so as to ensure at least the partial oxidation of the first element, in addition to the possible oxidation of the second element.

As has been indicated above, the first element must occur or be in a state in which it is conductive. It may hence occur in the part to be treated either in the metallic state, or in the form of an alloy, of a semi-metallic or inter-metallic compound with at least one other element, for example aluminum. It is important that, at least a part of the first element should be in the metallic state or conductive state before the application of the oxidation process.

As regards the second element recourse may be had to silicon, to aluminum, to tantalum, to uranium or to molybdenum in the metallic state.

These elements, as well as gallium, may also be used in the form of semi-conductor or even insulating compounds.

By way of example may be mentioned silicon nitride $Si_3N_4$ or aluminum nitride AlN, or again the silicides of molybdenum, uranium, tantalum, or aluminum. Gallium may also be used in the state of gallium phosphide GaP or gallium arsenide GaAs, etc.

It should however be understood that the second element may also be present initially in another form, even metallic such as aluminum, with the reservation that it can then form a semi-conductor or insulator oxide in a first phase of the anodic treatment.

Naturally it is self-evident that the thickness of the layers of the second element flush at least in part at the surface of the substrate must be all the thinner as the conductibility of the semi-conductor compound used containing this second element or formed from this second element, in the course of the anodic oxidation operation, is less, so as to enable the anodic oxidation operation itself.

The method according to the invention comprises various modes of putting into practice, which depend in particular on the material or substrate constituting the mass of the parts to which it is applied.

Thus the two associated elements may be formed directly by the elements on an alloy constituting the mass of the treated part, which is then subjected itself to the anodic oxidation treatment. The two elements may also be present in the form of an alloy in a surface deposit formed in a single layer on a substrate which can then be of any material.

However, it is particularly advantageous for the two elements to be present in different layers. The first element, selected from niobium, chromium, molybdenum tungsten, titanium or vanadium, can then be present in the substrate itself, if necessary alloyed with other elements, or constitute a lower layer of a surface deposit formed on any material. There is then formed on this substrate or on this lower layer, an upper layer constituted from the second element, selected from silicon, aluminum, gallium, tantalum, uranium and molybdenum, and the assembly is subjected to the anodic oxidation treatment until the oxidation of the second element and the oxidation, at least partially, of the first element, is ensured. However, the second element may, if necessary, be already present in the form of oxide in the upper layer formed, before the anodic oxidation treatment.

In a preferred embodiment of the method, a lower layer constituted by the first element, and an upper layer constituted by the second element, are successively deposited on the treated part. By this is meant that the two elements are respectively the principal constituents of the two layers, but that the latter may however contain other elements or other compounds in the state of traces or in sufficiently low proportions in order not to interfere with the process of formation of the coatings.

Preferably, the upper layer containing the second element is continuous. By way of indication, it may have a thickness comprised between about 70 and 150 Å. This value may also be greater if necessary.

The thickness of the layer of the first element is normally greater than 200 Å, preferably greater than 500 Å.

The method according to the invention, in the various embodiments, leads, after the anodic oxidation, to a coating in which a principal surface layer formed by the oxide of the first element may be distinguished. In the preferred case where an upper layer of the second element covering a lower layer or a substrate of the first element is subjected to anodic oxidation, a coating is obtained in which for example there may be distinguished a surface layer, principally formed from the oxide of the first element and separated from the rest of the first element, more or less oxidized, by an intermediate layer mainly formed by the oxide of the second element.

The invention arises in fact from the observation that certain elements such as niobium, chromium, molybdenum, tungsten, vanadium and titanium, when they are subjected to an anodic oxidation treatment show the property of migrating a long distance to form the oxide at the surface. The formation of the coating according to the invention may thus be explained by the migration of these elements through the layers of oxides of the different elements, suitably selected, which are for example silicon, aluminum, gallium, tantalum, uranium and molybdenum, these layers being if necessary formed by oxidation in the course of the first phase of the anodic treatment.

However, naturally, it must be understood that this attempt at interpretation of the phenomena may not in any case be used to limit the scope of the invention.

The invention relates also, in addition to the above-defined method, to the coatings obtained as well as the treated parts comprising such coatings. It relates in particular to a coating, and for example an anti-corrosion coating, which is characterized in that it comprises a surface layer formed mainly by an oxide selected from the oxides of niobium $Nb_2O_5$, chromium $Cr_2O_3$, molybdenum $MoO_3$ or tungsten $WO_3$, separated by an intermediate layer mainly formed by at least one different oxide selected for example from the oxides of silicon $SiO_2$, aluminum $Al_2O_3$, tantalum $Ta_2O_4$, uranium $UO_3$ or molybdenum $MoO_3$, or a nitride of silicon $Si_3N_4$ or of aluminum AlN, or a silicide of Mo, V, Ta or Al, or a phosphide or arsenide of gallium (GaP or GaAs), from a lower layer or substrate containing at least the element corresponding to the oxide of the surface layer, namely niobium, chromium, tungsten or molybdenum, said element being at least partially oxidized in the immediate vicinity of the intermediate layer.

The thickness of the superficial layer, formed from the oxide of the first element naturally depends on the conditions under which the anodic oxidation was carried out, notably its duration and the applied voltage. By way of indication, but without being limiting, the thickness of the layer may be comprised between about 100 Å and about 5000 Å, or even more.

The invention applies particularly to the anticorrosion protection of parts formed in their mass from the metal constituting the first element, niobium, chromium, tungsten or molybdenum, (excluding however titanium and vanadium which give rise to the formation of surface oxides having only a weak protective value), or from an alloy of this metal, and more particularly to parts produced from niobium or from an alloy of niobium. In this case, this method enables the obtaining of a surface layer of oxide, for example niobium oxide $Nb_2O_5$, of very slight thickness, easily controllable by the anodizing voltage applied, and which is smooth and regular, and this is achieved without spoiling the mechanical properties of the substrate, due to the fact that the anodizing treatment does not involve heating to a high temperature.

The invention also is applied, with the same advantages, to the protection of parts of other materials, for example of steel. In this case, chromium, molybdenum, or preferably niobium, is deposited or introduced at the surface of the substrate. The second element is also introduced at the surface, simultaneously or subsequently, for example, by a surface deposit of the element or of its oxide, before subjecting the whole to the anodizing operation. These deposits are formed by resorting to any known method in this field, of which examples will be indicated below. Naturally it is preferential to resort to one of those which can be applied at temperatures below threshold values above which the metal of the substrate becomes sensitive to oxidation, for example when working in an atmospheric medium.

Similar protective coatings, with a surface layer of oxide of niobium, of chromium or of molybdenum, may also be produced on substrates of a material containing the second element. Thus for example, it is possible to protect against corrosion at low temperature, parts of aluminum or of silicon by introducing into this material niobium which, subjected to the anodizing treatment migrates to the surface of the parts and forms a protective layer of $Nb_2O_5$, resistant especially to chlorine or other halogens.

It is pointed out that the $Nb_2O_5$ layer formed is continuous and entirely covers the parts of the surface treated by the method according to the invention. The thickness of this layer can be adjusted at will, for example as a function of the voltage applied in the course of the anodic oxidation operation (the thickness obtained depending also on the duration of the anodic oxidation and on the thickness of the sub-adjacent layer containing the second element, for example tantalum or aluminum, in the form of their respective oxides). It is naturally also possible to adjust the thickness of the coating formed by varying the duration of the anodic oxidation (for a given voltage of anodic oxidation). This parameter is however less easy to use than the magnitudes of the voltage applied, since these anodic oxidation operations are generally carried out in very short times, usually comprised between about 2 and about 20 minutes (except in the case of anodic oxidation by means of plasma which generally requires distinctly longer times).

In a particularly advantageous embodiment of the invention, which applies for example to the production of anti-corrosion coatings, two elements selected to constitute the coating are respectively niobium and aluminum. The coatings then have in combination the properties of the alumina $Al_2O_3$, which is very resistant to corrosion by oxygen, even at high temperature, and those of niobium oxide $Nb_2O_5$ which, if it does not provide protection with regard to oxygen at high temperature, ensures for its part resistance to corrosion at low temperature by oxygen.

In other words, the coatings thus formed have the combined properties of alumina $Al_2O_3$ and of niobium oxide. The alumina protects the sub-adjacent materials against corrosion at high temperature and constitutes an effective shield with respect to the migration of the oxygen and of the metallic species. The niobium oxide protects the layer of aluminum with respect to chemical corrosion very efficiently, for example under the effect of halogens and/or water in the liquid or vapor state, both at high temperature and at low temperature.

The niobium can for example constitute the substrate or be deposited on the substrate in a lower layer, whose thickness is preferably of the order of some thousands of angströms, then be covered by an upper layer of aluminum, whose thickness is preferably of the order of some hundreds of angströms. The subsequent anodic oxidation treatment is advantageously carried out until a coating oxidized over some thousands of angströms is obtained, preferably without entirely oxidizing the niobium.

In fact, and this is an important advantage of the method and of the coatings according to the invention, it is desirable in a general way not to continue the anodization to complete oxidation of the available atoms of the migrating element, niobium, chromium, tungsten or molybdenum, so that in the case of accidental deterioration of the coating, the latter can be easily regenerated, without introduction of additional material, by subjecting the coating again to an anodic oxidation treatment, which can remain very localized. Thus, for example, in the case of coatings where the elements are niobium and aluminum, an additional anodization causes the migration of a fraction of the niobium not yet oxidized through the alumina, and niobium oxide is reformed at the surface.

In the application of the method according to the invention, the deposition of the metallic layers then subjected to anodic oxidation, or that of the oxide layers can be done by any known technique, and for example by spraying in the case of an oxide layer, like alumina, or where a metallic layer is concerned, by electrolysis, spraying or vacuum deposition. For example, on a substrate which may be of iron, steel, of copper or of any other metals, alloy or semi-conductor material, there may be deposited a layer of niobium or some thousands of angströms thickness, then a layer of associated metal, such as aluminum, of some hundreds of angströms thickness, by conventional techniques of cathodic spraying. A surface deposit of aluminum and niobium alloy can also be produced by vacuum evaporation of the two elements simultaneously and annealed at about 400° C for a time of the order of 1 hour. Such an alloy can also be formed on the substrate by ionic implantation at low energy.

To carry out the anodic oxidation treatment, various methods known in themselves may be called upon. Mostly, the process carried out in aqueous or organic solution. Thus, in the case for example where the associated elements are niobium and aluminum, the anodic oxidation can be carried out in an aqueous solution of ammonium borate, or in an organic solution of ammonium borate, in glycol for example. The organic medium seems to be preferable to aqueous media in the case where the niobium is associated with silicon. As a modification, the anodic oxidation can be carried out, under voltage conditions similar to the preceding ones, in the presence of a so-called "solid" electrolyte, constituted in fact by a porous polymer impregnated with electrolyte and having a high conductivity in the cold. This technique has the advantage of facilitating the localization of the oxidation process on the surface of the treated part, when such a localization is desirable. The electrical contact is ensured by pressing the mass of electrolyte impregnated polymer lightly between the cathode and the treated part, forming the anode.

Another technique which may also be resorted to is that of anodic oxidation in plasma, in which the conduction between the treated part and the cathode is ensured by a plasma formed by a beam of electrons or at high frequency.

Within the scope of the application of the invention to the production of resistive structures, the substrate comprises essentially a resistive base layer formed on an insulating support. The resistive base layer and its insulating support may be constituted of any materials conventional in themselves in the technique of thin layer resistors. The support is generally of a ceramic material, but it can also be, for example, of silicon oxide. The resistive base layer is advantageously constituted of a material containing a metal, more particularly a metal such as tantalum. The metal may be if necessary in combined form, for example with nitrogen or with oxygen, or in the form of an alloy. However, it is preferable that it should be, at least partly, in a state oxidizable by anodic treatment. According to a preferred embodiment of the invention, the resistive base layer is formed of a material based on tantalum; in which the tantalum can if necessary be partly nitrided, or be in the form of an alloy, for example with aluminum or silicon, or again can contain dissolved oxygen, in an amount less than or equal to that of saturation, it being possible for the tantalum to be even partly in the oxide state.

The relative proportions of the constituents of the resistive base layer may be regulated, in conjunction with its thickness, so as to give this layer a suitable electrical resistance of a particular value before the anodic treatment. This value effects the overall resistance of the resistive structure finally obtained with the anodic oxidation, and its adjustment can serve to determine the order of magnitude of the overall resistance of the structure obtained. Naturally, other metals than tantalum can also be used as essential constituents of the resistive base layer, but tantalum is particularly advantageous since it permits in particular, the manufacture of resistive structures in which the value of the resistance has little sensitivity to variations in temperature.

In accordance with what has already been mentioned previously the two elements present in the parts of the substrate immediately sub-adjacent to its surface, that is to say in the surface of the resistive base layer within the scope of application to the production of resistive structures, can be in the metallic state or combined in alloys or other compounds. In addition, the first of them, or even both of them, may be mixed or combined with the material of the resistive layer. They can also, and preferably, be introduced onto this material in a distinct surface deposit, and be contained in this deposit either in a single layer of uniform composition, or in two different layers.

It is besides, particularly advantageous, within the scope of the application of the invention to the production of resistive structures, to continue the anodic oxidation so as to completely oxidize the first element. Preferably again, the anodic oxidation is effected so as to ensure not only the complete oxidation of this first element, but in addition, an oxidation at least partial of an oxidizable constituent of the resistive base layer, namely for example of the metal such as tantalum which it can contain. The determination of the thickness of the oxidized fraction of the resistive base layer enables the adjustment with accuracy of the final value of the resistance of the structure obtained.

In the various embodiments mentioned previously, it is also particularly advantageous to carry out the anodic oxidation under definite conditions of current strength and maximum voltage, corresponding to a preset value of the resistance of the manufactured resistive structure.

For application to the production of resistive structures, a modification of the method according to the present invention which is particularly advantageous, for example in the case where the resistive base layer is based on tantalum, is that where the second element is aluminum, in the metallic form or in the form of alumina, and where the first element is niobium. In resistive structures so obtained, the niobium oxide ensures protection against corrosion, whilst a continuous layer of alumina prevents the possible migration of oxygen and of cations towards the resistive layer, which ensures stability in time of the constitution of the resistive structure and of the value of its electrical resistance.

The invention relates also to resistive structures such as can be obtained by the above-defined method, or resistive structures including a coating according to the other methods mentioned formed on a substrate including a resistive thin layer on an insulating support.

It is a particular object of the invention to provide a resistive structure constituted from superposed layers comprising successively a surface layer formed an oxide of a first element selected from niobium, chromium, molybdenum or tungsten, and an immediately sub-adjacent intermediate layer, containing a second element selected for example from silicon, aluminum, gallium, tantalum, uranium and molybdenum, and occurring here in the form of a semiconductor, or even insulating compound, for example in the form of an oxide, an inner layer containing the same first element as the surface layer, at least partly oxidized in the immediate vicinity of the intermediate layer, and a resistive layer containing at least one metal such as tantalum, different from said second element, and formed on an insulating support.

In a preferred embodiment, the first element is substantially in the oxidized state throughout the whole thickness of the inner layer. The metal of the resistive base layer is also preferably in the oxidized state over a fraction at least of the thickness of this resistive layer.

The invention is described in more detail in the examples below. Examples 1 to 9 relate more particularly to the production of coatings with a surface layer of niobium oxide $Nb_2O_5$, but the techniques described can be adapted to the case where the niobium is replaced by chromium, tungsten or molybdenum. However, in a general way, the niobium has the advantage, over these other metals, of lending itself to the production of thicker coatings.

Figure 1:
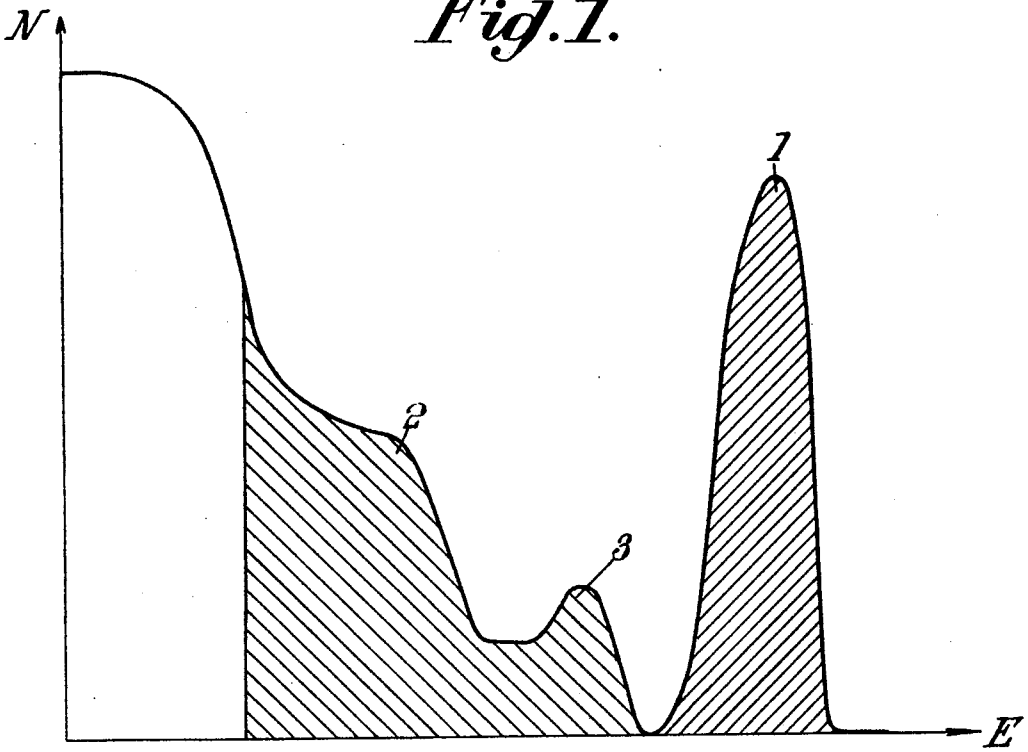

Within the scope of Examples 1 to 9, reference will be made to the FIGS. 1 and 2 attached, in which:

FIG. 1 shows a retrodiffusion helium ion spectrum through a coating obtained according to the invention, and FIG. 2 illustrates the structure of the coating which can be deduced therefrom.

EXAMPLE 1

Under the above-described conditions, the structures of coatings of oxides of niobium and of tantalum or of aluminum, produced on solid substrates of niobium, were examined.

On chemically polished specimens of niobium, there were deposited, by electron gun or by cathodic spraying, layers of tantalum whose thickness varied, from one specimen to the other, from 100 to 600 Å. These specimens were then subjected to anodic oxidation in baths of an aqueous solution of 5% by weight ammonium borate and of pH 7, at a constant current of 1 $mA/cm^2$ and constant temperature of 23° C±1° C for a time of some minutes. By varying the maximum anodic voltage, it was noted that the layer of tantalum is first oxidized, then an increasingly greater fraction of the niobium substrate.

Microanalysis by retrodiffusion of 1.8 MeV helium ions enables the energization curve of the niobium and tantalum atoms to be determined as a function of depth, since the energy of the particles retrodiffused by the tantalum (mass 181) is higher than that of the particles retrodiffused by the niobium (mass 93). The spectrum obtained for a thickness of tantalum of 200 Å and an anode voltage of 120 V, for example, corresponds to the diagram of FIG. 1, where the energies E are plotted as abscissae and the number of the particles N as ordinates.

On this diagram, the peak 1 corresponds to the tantalum, the zone 2 to the sub-adjacent niobium, and the peak 3, to an intermediate energy, points to the presence of niobium at the surface. This diagram shows therefore that in oxidizing, a part of the niobium cations form a layer of oxide at the surface, above the tantalum oxide. The coating thus comprises, according to the diagram of FIG. 2, a layer of tantalum oxide $Ta_2O_5$ between two layers of niobium oxide $Nb_2O_5$. In addition a slight mixing will be observed between the layer of niobium oxide fixed to the surface and the sub-adjacent tantalum oxide layer. The ratio of the area of the spectrum representing the niobium oxide fixed at the surface to that corresponding to the total oxide formed enables the proportion of niobium cations which thus migrate a long distance through the tantalum oxide, to be established (about 15% in the example concerned).

Moreover, the movements of the oxygen have been detected in the course of the formation of the oxidized coatings, by producing successively the first oxidation in a natural aqueous solution (oxygen 16), and a second oxidation in an aqueous solution enriched in oxygen 18, at a voltage higher (by 10 volts) than that used for the first oxidation.

Analysis of the successive oxidized layers, by observation of the energization curves of the reaction $O^{18}(p,\alpha)N^{15}$, shows that the order of the oxygen is preserved, the oxygen being fixed at the oxide/solution interface. It can be deduced therefrom that the migration of the niobium results from a physical phenomenon belonging to the cationic movement, and not to inhomogeneity of the tantalum oxide layer.

EXAMPLE 2

The results reported in Example 1 have been confirmed by other series of experiments where the thickness of the deposited layer of tantalum was equal to 100, 300 and 400 Å, whether the deposit of tantalum is effected by means of an electron gun or by cathodic spraying. The same results were obtained in the case of oxidation of deposits with two layers formed on an aluminum support, by the deposition of 1200 Å of niobium, and then 200 Å of tantalum.

EXAMPLE 3

Under the same conditions as in Example 1, but replacing the tantalum by aluminum, deposited by cathodic spraying, the migration over a long distance of 25% of the niobium cations through the aluminum oxide was observed.

EXAMPLE 4

Under the same conditions as in Example 3, by operating the anodic oxidation in a 5% by weight aqueous solution of ammonium borate and at the pH 7, but continuing it to a maximum voltage of 250 volts (about 6 minutes), the current being constant at 1 mA/cm$^2$, a total thickness of oxidized coating of 400 Å is obtained, including an intermediate layer of alumina $Al_2O_3$ between a surface layer of niobium oxide and a sub-adjacent layer of niobium which is oxidized in the zone neighboring the alumina.

A similar experiment, where the anodic oxidation is carried out in an 0.5% by weight aqueous solution of ammonium borate, led, for a maximum voltage of 500 volts, to a total thickness of oxidized coating of 7000 Å.

EXAMPLE 5

On niobium coated with aluminum as in Examples 3 and 4, an anodic oxidation was carried out by operating in a 1% organic solution of ammonium borate in glycol, at a constant current of 1 mA/cm$^2$, up to a maximum voltage of 200 volts. This voltage is maintained for 5 minutes. The temperature is constant, of the order of 20° C. As in the preceding case, a part coated with a film of $Nb_2O_5$ is obtained.

EXAMPLE 6

A solid niobium part was coated with a deposit of aluminum. The coated part was then subjected to anodic oxidation by means of a plasma. A plasma current of 50 mA in an atmosphere of oxygen under reduced pressure at $5.10^{-3}$ mHg was used. For a maximum voltage of 80 volts, an oxidized coating of 1600 Å was obtained. The temperature of the treated surface rose in this case to some 200° C and the treatment lasted about 20 hours.

EXAMPLE 7

Tantalum was deposited in traces on niobium, by cathodic spraying. The thickness of the deposits was comprised between 0.3 and 2 Å. From the helium retrodiffusion spectra established as was described in the Example 1, study of the position of the tantalum peak before and after anodic oxidation at 120 volts, for some minutes under the conditions of Example 1, showed that about 10% of the oxidized niobium had migrated to the surface during the operation.

As has been seen, one of the preferred applications of the invention resides in the formation of anti-corrosion coatings. Exceptionally advantageous results are obtained when the first element is constituted by niobium. It enables the production with ease, for example when the second element is based on aluminum, of films having thicknesses for example of about 1000 to about 4000 Å of niobium oxide $Nb_2O_5$, completely continuous and covering the whole of the surface of the substrate, whatever the initial surface state of the treated part.

It is possible in the same way to form on parts to be protected, coatings employing as the first element, chromium, tungsten or molybdenum instead and in place of the niobium. The superficial and continuous films of the oxides of these elements obtained at the surface of the parts to be protected are, all other operational conditions being otherwise the same, thinner than those obtained with niobium. The coatings obtained with chromium or tungsten are nevertheless very strong and protect the parts concerned effectively against corrosion. Similar results are obtained by using molybdenum. There is however an advantage in subjecting the coatings obtained to a thermal treatment to stabilize the molybdenum oxide components of the protective coatings formed.

The invention is also applied to the improvements in the protective qualities of the coatings formed by known methods. It is for example known to produce protective coatings on niobium based parts by resorting to deposits on the latter of compositions suitable for forming, after thermal treatment, films of niobium silicide $NbSi_3$ or of niobium aluminide $NbAl_3$ at the surface of such parts. The coatings, which are very hard, tend however to develop fissures when the parts are subjected to thermal stress, so that there is risk of loss of the protection that these coatings confer on these parts. It has already been proposed to improve this protection by "wetting" these parts at high temperature with for example an alloy containing aluminum, tin and silicon. This alloy then penetrates into the fissures in the course of formation and adheres to the walls of these fissures by capillarity. The wettability of these walls however is hindered by the outcrops of alumina.

The invention enables this difficulty to be overcome by treating the parts concerned by anodic oxidation, before placing them in contact with the liquid alloy, which has the effect of completely covering all the surfaces in question, including here the above-mentioned outcrops of alumina, with a thin film of niobium oxide $Nb_2O_5$ which, itself, is completely wettable by the liquid alloy.

It is also an object of the invention to provide an improvement in the known methods of the above-indicated type, for the purpose of obtaining a coating having both the hardness of known coatings of niobium parts based on niobium silicide or niobium aluminide, and a hitherto unknown flexibility enabling the coating to withstand effectively thermal or mechanical stresses of the type which have been envisaged above and which tend to produce fissurization of the known coatings.

This improved method consists of subjecting a part bearing a coating of the niobium silicide or aluminide type to a first anodic oxidation, in a medium in which the alumina or silicon oxide is partially soluble, then in subjecting this part to a second anodic oxidation in the midst of a medium in which the alumina or the silica is insoluble.

The first anodic oxidation has the effect of leading to the formation of a porous coating based on alumina and niobium oxide, this porosity resulting from the solution in the medium of a portion of the alumina formed by this anodic oxidation. The second anodic oxidation enables the formation of the film of niobium oxide on all the free microsurfaces, at least close to the substrate, under the conditions which have been stated above. In other words, a true coating of the microsurfaces and corresponding particles of alumina of the porous coating by films of niobium oxide is produced.

The coating thus formed then has at the same time the desired hardness and a sufficient flexibility, due to the initial porosity of the porous layer formed by the first anodic oxidation, to spare the coatings formed from the deterioration due to thermal or mechanical stresses.

The inclusion in the initial coating or the introduction of certain constituents in the medium used for the first anodic oxidation permits modification of the physical and mechanical characteristics of the coatings formed. For example the introduction of chromium oxide $CrO_3$ into the solution used for the first anodic oxidation enables ductile porous layers to be obtained, whilst the introduction of chromium sulfate leads to very hard porous layers.

There will be described below examples of the application of this modification of the method according to the invention.

EXAMPLE 8

The method according to the invention is applied to a niobium part whose surfaces are protected by a film of niobium aluminide $NbAl_3$. This film was formed by dipping the part into a suspension of aluminum particles in an organic solvent, for example a nitrocellulose laquer, by drying the part and heat treatment at high temperature (1200°–1400° C). The technique used is that described in Revue Physique Appliquée, Volume 5, 1970. The conditions used are those which enable a coating of niobium aluminide having a thickness of about 20 $\mu$ to be obtained.

The part thus covered with a coating of niobium aluminide is subjected to anodic oxidation in a 10 to 15% by weight aqueous solution of chromic oxide $CrO_3$. The anodic oxidation is carried out for 40 minutes at a voltage of 40 volts and at a temperature of 50°–55° C. This technique permits the formation of a surface layer of 8 $\mu$ thickness comprising a compact "barrier" in contact with the substrate and of 0.06 $\mu$ thickness, the whole remaining thickness of the film being porous. This film, formed by the oxides $Nb_2O_5$ and $Al_2O_3$, and containing inclusions of $CrO_3$, is very resistant to corrosion and ductile.

The part thus treated is then subjected to a second anodic oxidation in the midst of a solution of ammonium borate at a voltage of 160 volts, at a temperature of 20° C and for some minutes. This treatment has the effect of changing the thickness of the compact "barrier" from 0.06 $\mu$ to about 0.3 $\mu$. This treatment leads to a considerable increase in the resistance of the surface layer to corrosion. It is observed that the particles of alumina contained in the "barrier" are embedded in the mass of niobium oxide which has migrated from the substrate.

EXAMPLE 9

Starting from a niobium part coated with a film of niobium aluminide under the conditions described in the Example 1, a first anodic oxidation of the part is carried out in the midst of a 5% by weight solution of oxalic acid, containing 0.1 g/l of sulfuric acid and 1 g/l of chromium sulfate $Cr_2(SO_4)_3$, at a temperature of 5°–10° C, at a current density of 4.4 amperes per $dm^2$, at a voltage of 50 volts and for a duration of 20 minutes. A porous coating with a thickness of about 10 $\mu$ at the surface of the part is thus formed.

To increase the corrosion resistance of this porous film, a second anodic oxidation is then carried out under conditions identical to those described in Example 8.

A very hard porous coating whose hardness is of the order of 1000–1200 VPN units is then obtained.

EXAMPLE 10

Figure 3:
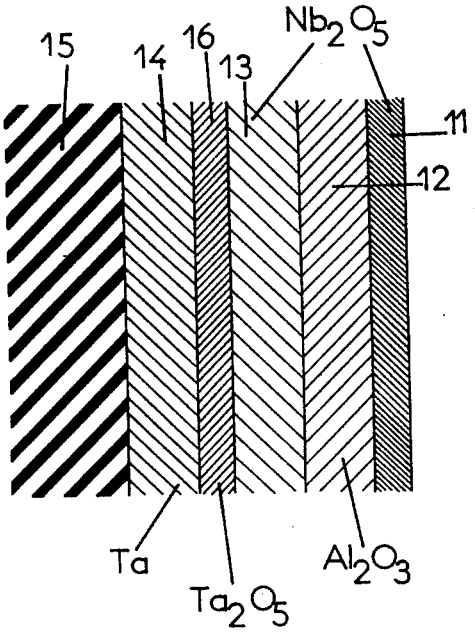

FIG. 3 shows, by way of example, a resistive structure according to the invention.

This structure is formed by anodic oxidation of a thin resistive layer of tantalum saturated with dissolved oxygen, borne by an insulating support of ceramic and on which there has been previously deposited a lower layer of niobium, then an upper layer of aluminum or of alumina. The thickness of the layer of tantalum is for example of the order of 1000 Å; the thickness of the layer of aluminum is of the order of some hundreds of angströms, and that of the niobium layer of the order of 500 Å. The anodic oxidation is carried out until the overall resistance of the structure obtained has the desired value, the latter being however selected so as to achieve the complete oxidation of the niobium and aluminum layers and the oxidation of a fraction of the resistive base layer. The anodic oxidation can be, in particular, done with a constant current strength up to a predetermined maximum voltage, corresponding to the value of the resistance to be obtained.

As shown in FIG. 3, the structure obtained at the end of this anodic oxidation treatment is constituted by superposed layers in which there is to be found a coating with three layers such as those which have been described previously, due to the fact of migration of the niobium through the layer of alumina in the course of the anodic oxidation. These layers comprise successively a surface layer 11 of niobium oxide $Nb_2O_5$, an intermediate layer 12 of alumina $Al_2O_3$, and an inner layer 13 also of niobium oxide $Nb_2O_5$, but separated from the surface layer by the alumina layer. The inner layer 13 is oxidized over its whole thickness.

The coating constituted by three layers 11, 12 and 13, covers in continuous manner, and over a constant thickness, the resistive layer 14 of tantalum or a tantalum alloy, borne by the insulating support 15. However, the resistive base layer itself forms, over a fraction of its thickness immediately sub-adjacent to the layer of niobium oxide 13, an additional stratum 16 constituted by tantalum oxide $Ta_2O_5$.

The resistive structure thus obtained has an electrical resistance whose value remains stable in time. The alumina layer protects it from possible variation by migration of atmospheric oxygen for example, whilst the upper layer of niobium oxide avoids corrosive attack. Moreover, the method of production used enables the obtaining of structures of predetermined and accurate resistances. This method has in addition various advantages, one of which is its simplicity and the fact that it resorts to an anodic oxidation treatment, that is to say the materials necessary are already present in the workshops of manufacturers of resistive layers using conventional methods.

In the foregoing example, the niobium and the aluminum can constitute, before the anodic oxidation treatment, a single homogeneous layer, or the niobium can be introduced as a constituent element of the resistive layer on which there is then formed a deposit of aluminum or of alumina before the anodic oxidation treatment.

Generally speaking the invention is applied to the treatment of parts provided with a substrate containing a first element such as has been defined above and comprising at its surface a porous film containing the second element, such as has also been defined above. It is then possible, by anodic oxidation, to cause the cations of the first element to migrate into the empty spaces of the porous structure to form an oxide of these cations.

The applications of the invention are not limited to the production of anti-corrosion coatings or of resistive structures of thin layers of predetermined resistance. Among the other possible applications, may be mentioned the formation of dielectric layers with variable surface indices. For example, starting from a substrate including at its surface niobium and coated with a dielectric layer of tantalum oxide $Ta_2O_5$ or of alumina, the migration of the niobium from the substrate through the dielectric layer up to the free surface of the latter can be caused.

The invention also applies with advantage to the modification of the refractive index of reflecting surfaces especially when recourse is had to substrates containing a first element and a second element such as defined above, whose refractive indices are very different. Thus the refractive index of alumina is equal to 1.65 and that of niobium oxide to 2.37. Starting with a surface formed on a substrate containing niobium and coated with a thin film of alumina, the value of the refractive index between the two above-indicated values can be modified at will, and consequently the reflective power of this surface, by producing anodic oxidation of this surface under the aboveindicated conditions, the voltage applied being determined by the final index desired. A method is thus obtained enabling the variation, within wide limits of the geometrical characteristics of a beam of light reflected by this surface and the distribution of the light in a cross-section of this beam, by modification of the indices of the various parts of the reflecting surface, under the conditions which have been described, without it being necessary to modify the geometrical shapes themselves of this surface.

As is self-evident and as emerges already from the foregoing, the invention is in no way limited to those of its types of application and embodiments which have been more especially envisaged; it encompasses on the contrary, all modifications.

We claim:

1. The method of providing a metallic part susceptible to corrosion with a corrosion-resistant coating, which comprises depositing onto said metallic part a surface layer of a first material selected from the group of materials consisting of niobium, chromium, tungsten and molybdenum in the metallic state or of a conducting compound or alloy containing said first material, depositing on said surface layer, a top layer of a second metal material different from said first material and selected from the group consisting of aluminum, silicon, gallium, tantalum, uranium and molybdenum, either in the metallic state if it forms itself a semi-conductive or an insulator, or combined or alloyed with at least one other element to form a semi-conductor compound and then subjecting the surface layer to anodic oxidation, thus causing metal of the surface layer to migrate through and onto the metal of the top layer, and forming thereon a coating of an oxide of the one of the metals of the surface layer, and interrupting the anodic oxidation prior to the complete oxidation of the first element of the surface layer, whereby there is formed on the three-layer corrosion-resistant coating of an oxide of the metal of the surface layer, subjacent the top layer, metal of the surface layer still being in the metallic state, the top layer in an oxidized state and an oxide of the metal of the surface layer overlying the top layer.

2. The process of claim 1 wherein the material of the top layer is one of the following: aluminum, silicon, gallium, tantalum or uranium.

3. The method of claim 1 for regeneration of the corrosion resistant coating which comprises subjecting again the surface layer to anodic oxidation, thereby causing migration of metal of the surface layer which is not yet oxidized through and onto the material of the top layer, thereby regenerating the coating.

4. The method of claim 1, wherein said metallic part to be protected against corrosion is formed of material different from the metals of surface layer.

5. The method of claim 1 wherein the top layer of a second material different from said first material is selected from the group consisting of aluminum, silicon, gallium, tantalum and uranium.

6. The method of claim 1, wherein the first material is niobium.

7. The method of claim 6, wherein said anodic oxidation is effected until an upper-superficial and continuous film of niobium oxide having a thickness from about 1000 to about 4000 angstroms is obtained on the whole surface of said metallic part.

8. The method of claim 7, wherein said second material is aluminum.

9. The method of claim 1, wherein the first material is chromium or tungsten.

10. The method of claim 1, wherein the second material is aluminum.

11. The method of claim 1, wherein the second material is silicon, aluminum, tantalum, uranium or molybdenum.

12. The method of claim 1, wherein the second material is an oxide, selected from the group consisting of silicon oxide $SlO_2$, uranium oxide $UO_2$, gallium oxide $Ga_2O_3$, tantalum oxide $Ta_2O_5$, aluminum oxide $Al_2O_3$ and molybdenum oxide $MoO_3$.

13. The method of claim 1, wherein said metallic part to be protected against corrosion is formed of a metal selected from said first materials.

14. The method of claim 13, wherein said metallic part is formed of niobium or of a niobium alloy.

15. The method of claim 1, wherein said metallic part to be protected against corrosion is formed of a metal other than any of said first elements.

16. The method of claim 1, wherein said layer of said second element has a thickness of from about 70 to 1000 angstroms.

17. The method of claim 1, wherein said first layer of said first material has a thickness from about 100 to about 5000 angstroms and said layer of said second material has a thickness from about 70 to 1000 angstroms.

18. The method of claim 1, wherein said second material is aluminum, tantalum or silicon.

19. The method of claim 1, wherein said niobium layer is thick enough to enable the formation by anodic oxidation on the whole surface of said metallic part of an upper-superficial and containuous film of niobium oxide having a thickness from about 1000 to about 4000 angstroms.

20. The method of claim 14, wherein said second material is aluminum.

21. The method of claim 1 wherein the second material is selected from the group consisting of silicon nitride, aluminum nitride, and the silicides of molybdenum, uranium, tantalum and aluminum.

22. The method of claim 1 wherein the first material chromium or tungsten.

23. The method of claim 1 wherein the second material is gallium in the form of gallium phosphide or gallium arsenide.

24. The method of claim 1 wherein said first material molybdenum, said method further comprising, subsequently to the anodic oxidation treatment, subjecting said metallic part to a thermal treatment to stabilized the molybdenum oxide.

* * * * *